US007988601B2

(12) United States Patent
Bowser

(10) Patent No.: US 7,988,601 B2
(45) Date of Patent: Aug. 2, 2011

(54) SEATED ROW EXERCISE SYSTEM

(75) Inventor: John Bowser, Las Vegas, NV (US)

(73) Assignee: VQ Actioncare, LLC, Irvine, CA (US)

( * ) Notice: Subject to any disclaimer, the term of this patent is extended or adjusted under 35 U.S.C. 154(b) by 0 days.

(21) Appl. No.: 12/772,011

(22) Filed: Apr. 30, 2010

(65) Prior Publication Data

US 2010/0210425 A1 Aug. 19, 2010

Related U.S. Application Data

(60) Continuation of application No. 12/020,685, filed on Jan. 28, 2008, now Pat. No. 7,708,670, which is a continuation-in-part of application No. 11/766,299, filed on Jun. 21, 2007, now Pat. No. 7,621,852, which is a division of application No. 11/490,198, filed on Jul. 20, 2006, now abandoned, which is a continuation-in-part of application No. 11/062,063, filed on Feb. 18, 2005, now Pat. No. 7,322,907, which is a continuation-in-part of application No. 10/783,532, filed on Feb. 21, 2004, now Pat. No. 7,381,168.

(51) Int. Cl.
*A63B 21/00* (2006.01)

(52) U.S. Cl. ..... 482/57; 482/904; 482/61

(58) Field of Classification Search ..... 482/907, 482/904, 121, 126, 92, 102, 104, 99, 98, 482/103

See application file for complete search history.

(56) References Cited

U.S. PATENT DOCUMENTS

| | | | | |
|---|---|---|---|---|
| 704,840 | A | 7/1902 | Korth | |
| 861,620 | A * | 7/1907 | Thompson | 482/129 |
| 1,279,120 | A | 9/1918 | Kellogg | |
| 2,267,376 | A | 12/1941 | Van Straaten | |
| 2,803,349 | A | 8/1957 | Talbot | |
| 3,606,321 | A | 9/1971 | Macoulis | |
| 3,677,543 | A | 7/1972 | Richardson | |
| 3,738,649 | A | 6/1973 | Miller | |
| 3,843,119 | A | 10/1974 | Davis | |
| 4,019,734 | A | 4/1977 | Lee | |
| 4,251,071 | A | 2/1981 | Norton | |
| 4,262,902 | A | 4/1981 | Dranselka | |
| 4,316,616 | A | 2/1982 | Boivin | |
| 4,390,177 | A | 6/1983 | Biran | |
| 4,572,501 | A | 2/1986 | Durham | |
| 4,720,099 | A | 1/1988 | Carlson | |
| 4,733,862 | A | 3/1988 | Miller | |
| 4,739,984 | A | 4/1988 | Dranselka | |
| 4,788,754 | A | 12/1988 | Fukumoto | |
| 4,830,363 | A | 5/1989 | Kennedy | |
| 4,838,547 | A | 6/1989 | Sterling | |
| 4,852,874 | A | 8/1989 | Sleichter, III | |
| 4,913,423 | A | 4/1990 | Farran | |
| 4,921,247 | A | 5/1990 | Sterling | |
| 5,029,850 | A | 7/1991 | Van Straaten | |

(Continued)

*Primary Examiner* — Jerome W Donnelly

(74) *Attorney, Agent, or Firm* — Lawrence N. Ginsberg

(57) ABSTRACT

A seated row exercise system including an exercise cycle assembly that detachably connects to a chair frame of a chair; and, an elongated support assembly. The exercise cycle assembly includes a main frame having a first end portion detachably connectable to a frame element of a chair frame, the main frame including a plurality of support legs for supporting the exercise cycle assembly relative to the floor; and, a pedal assembly securely connected to the main frame. The elongated support assembly includes a substantially vertical support member secured to the main frame; and, a pulley housing assembly attached to the vertical support member for supporting a cable assembly.

15 Claims, 3 Drawing Sheets

U.S. PATENT DOCUMENTS 5,044,633 A 9/1991 Rice
5,080,353 A 1/1992 Tench
5,112,287 A 5/1992 Brewer
5,176,601 A 1/1993 Reynolds
5,250,016 A 10/1993 Higgins
5,324,243 A 6/1994 Wilkinson
5,362,296 A 11/1994 Wang
5,387,171 A 2/1995 Casey
5,417,643 A 5/1995 Taylor
5,470,298 A 11/1995 Curtis
5,496,246 A 3/1996 Pierre
5,674,167 A 10/1997 Piaget
5,690,594 A 11/1997 Mankovitz
5,769,556 A 6/1998 Colley
5,779,601 A 7/1998 Ish
5,839,995 A * 11/1998 Chen ..... 482/92
5,899,836 A 5/1999 Chen
5,921,900 A 7/1999 Mankovitz
6,113,522 A 9/2000 Fontenot
6,117,056 A 9/2000 Cataldi
6,159,133 A 12/2000 Shugg
6,228,004 B1 5/2001 Steinbach
6,319,179 B1 11/2001 Hinds
6,450,929 B1 9/2002 Markham
6,500,104 B1 12/2002 Rich
6,508,749 B1 1/2003 Broadwater
6,544,152 B2 4/2003 Rosati
6,770,014 B2 8/2004 Amore
6,790,163 B1 9/2004 Van De Laarschot
6,840,894 B2 1/2005 Lerner
6,872,170 B2 3/2005 Kuo
6,908,417 B2 6/2005 Jackson
6,926,237 B2 8/2005 Shereyk
6,976,941 B2 12/2005 Britt
7,229,392 B2 * 6/2007 Turnbull et al. ..... 482/129
7,354,384 B2 4/2008 Martin
7,621,852 B2 11/2009 Bowser
2002/0077228 A1 6/2002 McBride
2002/0173412 A1 11/2002 Stearns
2004/0152572 A1 8/2004 Reitz
2004/0185991 A1 9/2004 Bowman
2004/0245836 A1 12/2004 Kropa
2008/0220945 A1 9/2008 Chen

* cited by examiner

SEATED ROW EXERCISE SYSTEM

CROSS REFERENCE TO RELATED APPLICATIONS

This is a continuation of U.S. Ser. No. 12/020,685, entitled "Seated Row Exercise System", filed Jan. 28, 2008, which is a continuation-in-part of U.S. Ser. No. 11/766,299, entitled "Exercise Cycle Assembly", filed Jun. 21, 2007, which is a divisional of U.S. Ser. No. 11/490,198, entitled "Exercise Cycle Assembly", filed Jul. 20, 2006 which is a continuation-in-part of U.S. Ser. No. 11/062,063, entitled "Exercise System Using Exercise Resistance Cables", filed Feb. 18, 2005, which is a continuation-in-part of U.S. Ser. No. 10/783,532, entitled "Exercise System Using Exercise Resistance Cables", filed Feb. 21, 2004.

BACKGROUND OF THE INVENTION

1. Field of the Invention

The present invention relates to exercise and rehabilitation devices and systems and more particularly to a seated row exercise/rehabilitation system that utilizes an exercise cycle assembly that connects to an exercise chair in connection with an elongated support assembly with a vertical support member that connects to a pulley system providing seated row motions.

2. Description of the Related Art

The use of resistance cables for exercising is well known in the prior art. There are a multitude of different exercise systems and devices that have been previously disclosed or are currently in the market to supply the increasing demand for physical fitness. Many of these utilize resistance cables. For example, as far back as 1902, U.S. Pat. No. 704,840, issued to J. C. Korth et al., disclosed the use of an exercising machine employing elastic cords. U.S. Pat. No. 3,606,321, issued to N. D. Macoulis, discloses the use of elastic cords and a pole. U.S. Pat. No. 3,843,119, issued to R. P. Davis, discloses the use of a machine for exercising the arm muscles while the user stands upon a base.

U.S. Pat. No. 4,019,734, issued to W. Lee et al., discloses an elastic resistance type exercising device having a single length of latex rubber surgical tubing whose two ends are formed into size handle loops by the use of leather fasteners. The handle loops are sleeved with vinyl tubing, and plugs are inserted in each of the open ends of tubing, that have twice passed through the fasteners to form the loops, to prevent the tubing from being pulled out of the fasteners. A user grasps the handle loops or secures them about his ankles and pulls against the elastic resistance. Two additional flexible sleeves are slidably mounted over the portion of the elastic tubing between the fasteners.

U.S. Pat. No. 3,677,543, issued to J. H. Richardson, discloses a pull type exercising device including a single piece of elastic tubing with loops formed at the respective ends of the tubing by s-shaped hooks that receive folded ends of the tubing. On each looped portion there is a sleeve. A slideable ring with an anchoring attachment is mounted on a tubular member. A user inserts an arm or leg in the loops and pulls his arm or leg and pulls on the anchored tubular member.

U.S. Pat. No. 6,508,749, issued to R. L. Broadwater, discloses a portable exercise device that includes an elastic cord with two ends. Each of the ends of the cord is received into opposite sides of a coupling. A clamp element is provided around a portion of the coupling. The clamp element compresses the coupling around the elastic cord to hold the cord in place inside the coupling. A handle may be provided around the coupling. The handle may be made from a resilient material so that the hand of the user may squeeze it. Additionally, end plugs may be provided for the handle to prevent the handle from slipping off the coupling.

U.S. Pat. No. 4,251,071, issued to Craig D. Norton, discloses an exercising device that comprises an elongated elastic cord with a foot-receiving loop formed at each end and a hollow hand grip with an axial bore extending from end to end with a longitudinally extending split permitting one or two lengths of the elastic rope to be inserted into the bore. The hand grip may be squeezed by the hand for causing the wall of the bore to frictionally grip the rope. The hand muscles are exercised by this squeezing action on the hand grip and the arm and shoulder muscles are exercised when the hand grip pulls on the rope to elongate it.

U.S. Pat. No. 4,852,874, issued to C. G. Sleichter, III et al., discloses an exercise device that includes an elastic loop having free ends spliced together, generally tubular handles disposed in diametrically opposed relation to one another on the loop and an elastic retainer sleeve surrounding intermediate portions of the loop between the handles. The device is conformable for use in performing a wide variety of exercises and for performing a selected number of repetitions of each exercise by grasping the handles and stretching against the resistance load of the loop and the retainer means. The handles can be grasped either by the hands or by a combination of hands and feet to perform various exercises or may be grasped between the feet or ankle portions to perform other exercises. In modified forms of the invention, one of the handles is made rigid so as to simulate a racquet or golf club handle to be used in practicing forehand and backhand strokes or to simulate the golf swing. The exercises may be performed effectively in either the standing, sitting or fully prone position. Other modified forms of invention include an anchor strap to facilitate practicing of the golf swing and a splice for joining together free ends of the loop into a unitary member.

U.S. Pat. No. 4,733,862, issued to J. V. Miller discloses an elastic resistance exerciser comprising an elongated elastic member having a loop formed at each end, a tubular handle slidably fit onto each loop of the elastic member, and a self-locking slider having three holes; with the elastic member slidably threaded through two of the holes and terminating the end of each loop in the third hole of each slider; the slider being adjustable along the elastic member, whereby the size of the loop may be varied by moving the slider with no tension on the loop, but self-locking by the application of tension to the loop. A preferred embodiment provides a band of flexible material attached approximately to the center of the length of an elastic member having more than one elastic element.

The above-mentioned patents each use elastic cable which functions as a resistance tool for exercising the body. In some cases the elastic/rubber cable is the only thing necessary to achieve the complete workout. In other cases a secondary product, such as a door, a handle or some sort of stationary device is required in order to use the product as designed.

There are a variety of patents that disclose exercise systems related to chairs. For example, U.S. Pat. No. 5,470,298, issued to J. L. Curtis; U.S. Pat. No. 5,417,643, issued to M. D. Taylor; U.S. Pat. No. 5,387,171, issued to M. E. Casey; U.S. Pat. No. 5,080,353, issued to L. Teach; U.S. Pat. No. 5,044,633, issued to B. A. Rice; U.S. Pat. No. 4,921,247, issued to J. F. Sterling; U.S. Pat. No. 4,838,547, issued to J. F. Sterling; U.S. Pat. No. 4,720,099, issued to R. B. Carlson; U.S. Pat. No. 1,279,120, issued to J. H. Kellogg; U.S. Publicn No. 2002/0173412 to K. W. Stearns; and, U.S. Publicn No. 2002/0077228 to R. W. McBride each disclose chair-related related exercise devices which have generally complicated designs.

U.S. Pat. No. 4,913,423, issued to M. R. Farran, discloses a furniture article, such as a seating article, for residential and office use that includes a frame housing, one or more exercise apparatus that are located in the armrest, the back and the seating base. The frame is selectively covered to provide the seating article with the appearance of a conventional furniture article used in the home or office. Each exercise apparatus employs a cable extending through the covering to communicate a source of resistive force from within the frame to a user outside of the frame. On the end of the cable outside of the covering is a handle or a foot stirrup by which the user pulls the cable out of the seating article. A cover conceals the handle or foot stirrup as well as the end of the cable while the exercise aspects of the furniture article are not being utilized. As in the other patents, discussed above, the Farran system is somewhat complicated. Furthermore, it is non-mobile and is limited in the amount of workout routines allotted.

U.S. Pat. No. 5,362,296, issued to L. Wang et al., discloses a chair mounting exercising unit includes two swinging arms having a bottom end fastened to either end of a substantially U-shaped locating rod being fixed to the back of a chair by a knob controlled lock device and a slotted side extension plate in the middle at an outer side movably hung on a screw bolt at either end of a horizontal frame on the back of the chair and a top end coupled with a pulley wheel assembly, and two elastic pull ropes respectively inserted through either pulley wheel assembly and fastened to either swinging arm and an opposite end coupled with a handle. With the increasing population of elderly persons and their desire for increased exercise there is a concomitant growing need for exercise equipment that the elderly can easily and efficiently use. The '296 patent system has two swinging arms each having a bottom end connected to either end of the locating rod and attached to either locating wheel. A mobile/moving system is not generally preferred for use with the elderly and is somewhat complicated. Positioning of the swinging arms requires time and labor. The present invention, as will be disclosed below, is designed for specific exercises and is excellent for users who have limited range of movement. It allows for a very stable environment minimizing movement in the setup process and eliminating the need for pulley arms. The present invention also allows the user to change cables without having to get up from the chair since all of the cable connections are set up on the sides of the chair versus the cables connections being on the back of the chair as disclosed in the '296 patent.

U.S. Pat. No. 5,674,167, issued to G. D. Piaget et al., discloses a strength training exercise apparatus includes a frame having an upright back rest, and a horizontal seat, and further includes opposing arm members pivotally mounted to the back rest. The arm members are movable through an arcuate range of motion, and include locking pins for selectively locking the arm members in desired angular positions. The apparatus still further includes a resistance assembly consisting of a fixed anchor mounted on the frame, a movable anchor which is movable relative to the fixed anchor, and a plurality of elastomeric resistance cords releasably secured between the movable anchor and the fixed anchor to provide resistance to movement of the movable anchor. A pull line is mounted on guide pulleys along the length of the arm members, and is received in association with the movable anchor whereby outward movement of the pull line with respect to the arm members causes movement of the movable anchor with respect to the fixed anchor. The exercise apparatus further consists of a leg member pivotally mounted to the seat, and a second resistance assembly including a second movable anchor coupled to the leg member, and a second plurality of elastomeric resistance cords secured between the fixed anchor and the second movable anchor for providing resistance to pivotal movement of the leg member. Seniors need ease of use when it involves getting on and off of the chair. The '167 patent system has opposing arm members pivotally mounted to the back rest. The arm members are movable through an arcuate range of motion and include locking pins for selectively locking the arm members in desired angular positions. While using the '167 device the user typically needs to get off of the chair in order to make the rear and lower connections. As noted above and as will be disclosed below, the exercise chair of the present invention allows the user to remain seated to make the necessary connections on the side of the chair.

U.S. Pat. No. 5,899,836, issued to P. Chen, discloses an exerciser includes a foot support secured in front of a base. A lever has a lower portion pivotally coupled to the base and has a bracket and a seat cushion pivotally secured on tops for allowing the seat cushion to be moved upward and downward. A tube is secured to the bracket for supporting one or more pulleys. The base has one or more pulleys secured to the front and the rear portions. One or more resilient members are engaged with the pulleys. A handle may be secured to the resilient member for conducting pulling exercises. The tube and a pulley may be moved upward and downward in concert with the seat cushion. The present invention does not have a secured foot rest and does not require the use of levers. The '836 design requires many steps for exercise setup and disassembly.

U.S. Pat. No. 6,117,056, issued to T. F. Cataldi, Jr. et al., discloses an exercise device attachable to the seat portion of a chair to resist forces applied in performing isotonic exercises. The device includes a strap securable to a chair and a seat pad positionable on the strap for supporting an exerciser and has D-rings secured to the strap and the seat pad for attachment of an elastic band for performing arm isotonic exercises with a hand band attachment. The device also includes a front flap securable at one end between the seat pad and strap and securable at an opposite end to a downwardly forward portion of the chair for performing leg isotonic exercises with an attached elastic band and an ankle strap attachment.

U.S. Pat. No. 6,159,133, issued to R. C. Shugg, discloses a seat mounted workout station system is provided including a seating assembly having a seat portion and a back portion. Also included is a frame mounted on a rear surface of the back portion of the seating assembly. Next provided is a plurality of tension members connected to the frame and further connected to cables which are routed through the frame via pulleys. Hand grips are connected to the cables for being gripped by a user.

As noted above, with the increasing population of elderly persons and their desire for increased exercise there is an associated growing need for exercise equipment that the elderly can easily and efficiently use. As will be disclosed below, the present invention satisfies these needs.

SUMMARY OF THE INVENTION

In one broad aspect, the present invention is seated row exercise system including an exercise cycle assembly that detachably connects to a chair frame of a chair; and, an elongated support assembly. The exercise cycle assembly includes a main frame having a first end portion detachably connectable to a frame element of a chair frame, the main frame including a plurality of support legs for supporting the exercise cycle assembly relative to the floor; and, a pedal assembly securely connected to the main frame. The elongated support assembly includes a substantially vertical support member secured to the main frame; and, a pulley housing assembly attached to the vertical support member for supporting a cable assembly.

The first end portion preferably includes an elongated connecting member having a generally u-shaped cross-section for engagement with the frame element of the chair. Generally, it connects to a horizontal crossbar of the chair.

The pulley housing assembly preferably includes a pulley housing attached to the vertical support member; and, a pair of pulleys attached to the pulley housing to swivel in an orthogonal direction from a plane of the vertical support member (i.e. swing side to side).

A cable assembly preferably includes a pair of cables, each cable including a cable attaching element at a respective second end of each of the cables; and, a pair of handles, each handle secured at a respective first end of one of the cables.

The systems of the present invention are particularly advantageous for use with elderly persons. The present invention is easy to use, particularly for the elderly, because, assuming that the chairs are set up, the person merely picks up the desired cables and brings those cables to his or her workout station, attaches the cable(s) and is ready to work out.

Similarly, the exercise cycle assembly can easily be connected to the exercise chair.

Foldable chairs may be utilized that can be stored or kept in a variety of places such as in the home, hotels, retirement communities, health clubs, and physical therapy centers. Use of such foldable chairs provides a very mobile environment.

The present exercise system provides strength training without the stress of a pre-designed rigid machine. A person can take cables, connect them to the anchor assembly and exercise in accordance with his body height and size.

The chair may be integrated into a universal gym system and utilized with a variety of exercises.

Use of the present invention has several advantages over the prior art. It allows the user to easily change resistance levels and adjust resistant lengths—all from a seated position. The present inventive concepts provide safe, low impact exercise solutions that are easy to use and make the user feel better. The folding resistance chair provides a very convenient home exercise system. The chair allows the user to perform a full body workout from a safe, comfortable seated position. When seated, balance and stability is maintained as the arms, chest, shoulders, abdomen, back, and legs are exercised. The anchor assemblies ensure that the cable remains at the best angle for each exercise. The unique cable system offers a wide range of upper body and lower body exercises and provides resistance without use of heavy weights. When utilizing the resistance cables with the resistance chair, the user is provided with a safe, comfortable, secure and well rounded exercise routine.

The resistance chair has a pair of front legs that are each forwardly curved at an intermediate region thereof to enhance weight distribution for optimizing stability. This weight distribution design ("WDD") provides a secure and safe structure particularly advantageous utilizing recommended balance bar exercise routines.

DETAILED DESCRIPTION OF THE INVENTION

Figure 1:
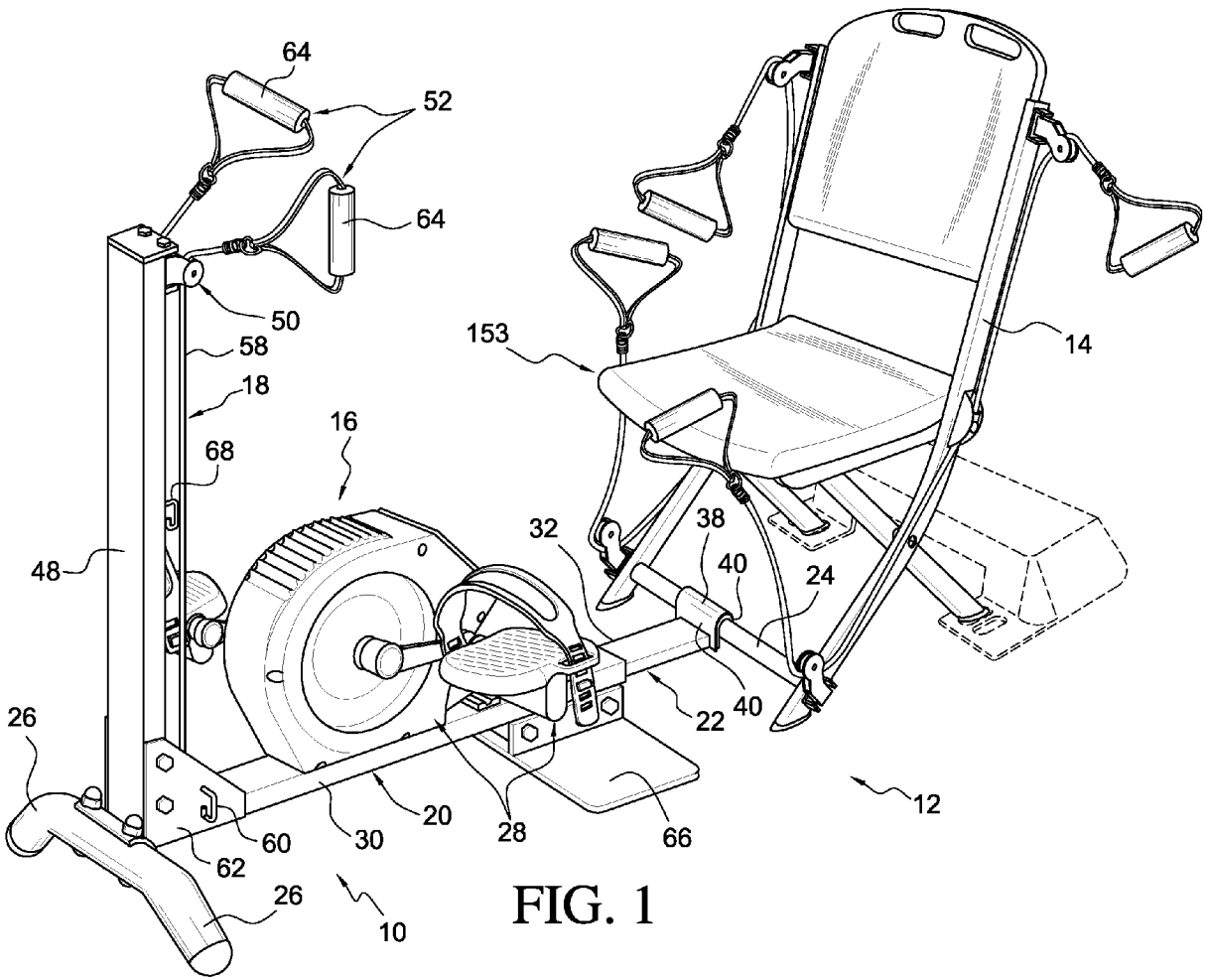
FIG. 1 is a front perspective view of the seated row exercise system of the present invention utilized with an exercise chair.

Referring now to the drawings and the characters of reference marked thereon, FIG. 1 illustrates a first embodiment of the seated row exercise system of the present invention, designated generally as 10, which can be used in conjunction with a support structure, preferably a chair 12. The seated row exercise system 10 detachably connects to the chair frame 14 of the chair 12. It includes an exercise cycle assembly 16 and an elongated support assembly 18.

The exercise cycle assembly 16 includes a main frame 20 having a first end portion, designated generally as 22, detachably connectable to a frame element 24 of the chair frame. The main frame 20 of the exercise cycle assembly 16 includes support legs 26, preferably located at a second, opposite end portion, for supporting the exercise cycle assembly 16 relative to the floor. A pedal assembly, designated generally as 28, is securely connected to the main frame 20. The pedal assembly 28 may be of a conventional type and can be belt driven or magnetic wheel driven with an LCD display.

Figure 2:
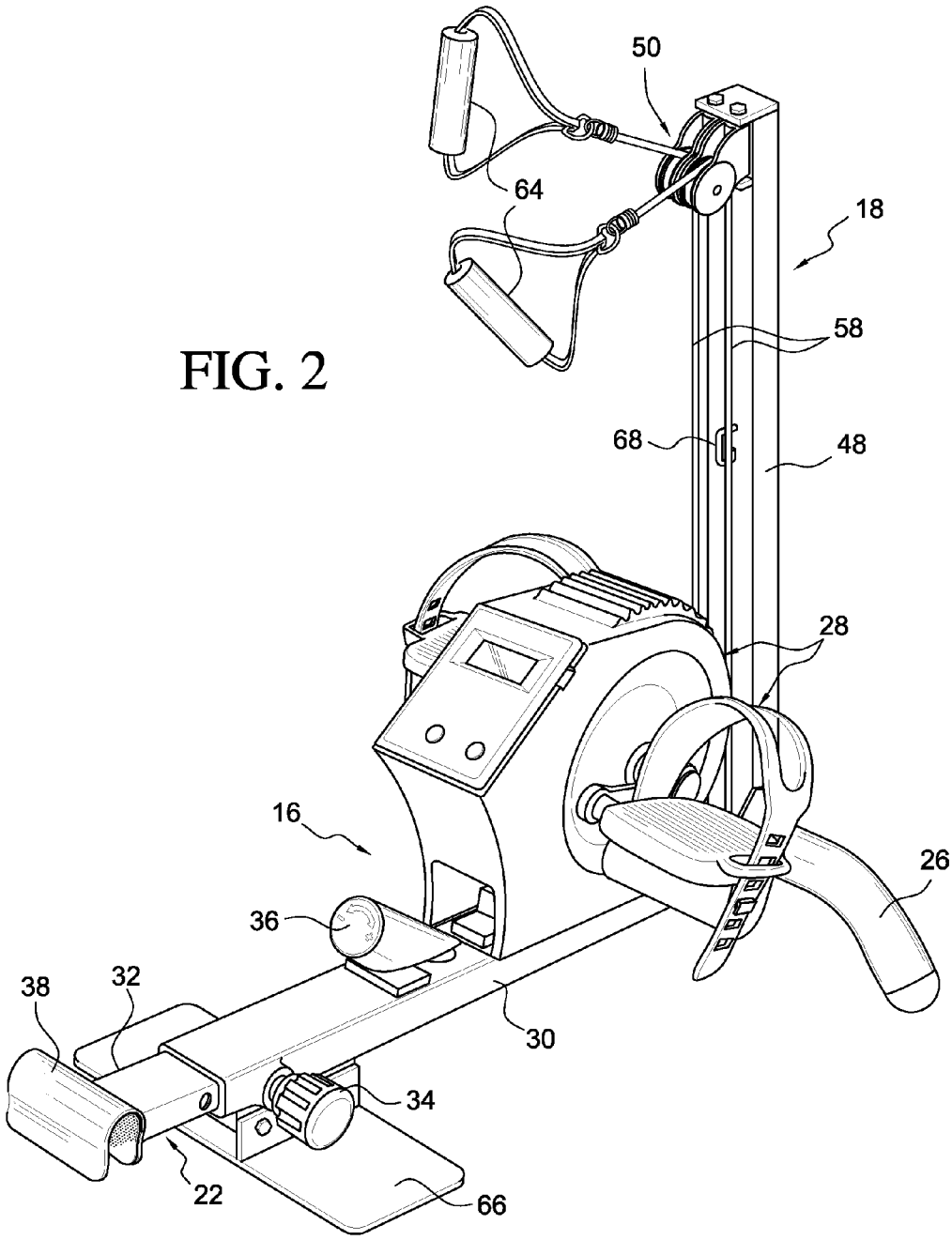
FIG. 2 is a rear perspective view of the seated row exercise system of the present invention with two exercise resistance cable apparatus' shown attached thereto.

The main frame 20 includes an elongated main support element 30 for supporting the pedal assembly 28. The first end portion 22 includes a stem 32 in adjustable telescopic engagement with the main support element 30 for changing the position of the chair frame relative to the pedal assembly 28 and setting that position. As can be seen in FIG. 2 an adjustment knob 34 can be used to adjust the position of the chair frame relative to the pedal assembly 28. The pedal assembly 28 typically has an LCD display and knob 36 for adjusting the tension. An elongated connecting member 38 is securely connected to the stem 32 by soldering or suitable adhesive bonding.

Figure 3:
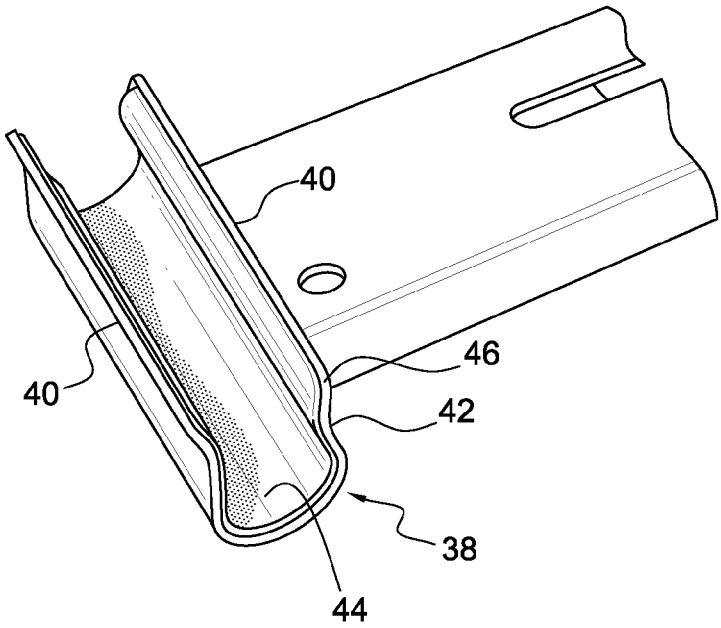
FIG. 3 is an enlarged perspective view of an end portion of the exercise cycle assembly of the seated row exercise system including the elongated connecting member thereof.

As can be best seen in FIG. 3, the elongated connecting member 38 has a generally u-shaped cross-section which is open on its lower end for engagement with the frame element, i.e. horizontal crossbar 24, of the chair frame. The sides 40 of the elongated connecting member 38 preferably have recessed portions 42 for providing a snapping engagement with the frame element. It also preferably includes an inner padding 44 positioned on an inner surface thereof for enhancing the engagement of the elongated connecting member and the frame element. The ends 46 of the sides 40 of the connecting member 38 are preferably slightly v'd out to minimize peeling of the inner padding while the connecting member 38 is snapped into position. The inner padding 44 is preferably formed of hardened rubber.

The exercise cycle assembly 16 of this invention is disclosed and claimed in applicant's patent application, U.S. Ser. No. 11/490,198 (U.S. Publication No. 2006/0258520), entitled "Exercise Cycle Assembly," which is incorporated herein in its entirety. U.S. Ser. No. 11/766,299, the parent to this patent application, is a divisional application to U.S. Ser. No. 11/490,198.

The elongated support assembly 18 of the seated row exercise system 10 of the present invention includes a substantially vertical support member 48 secured to the main frame 20; and, a pulley housing assembly 50 attached to the vertical support member 48 for supporting a cable assembly 52. The vertical support member 48 may have an adjustable length.

Figure 4:
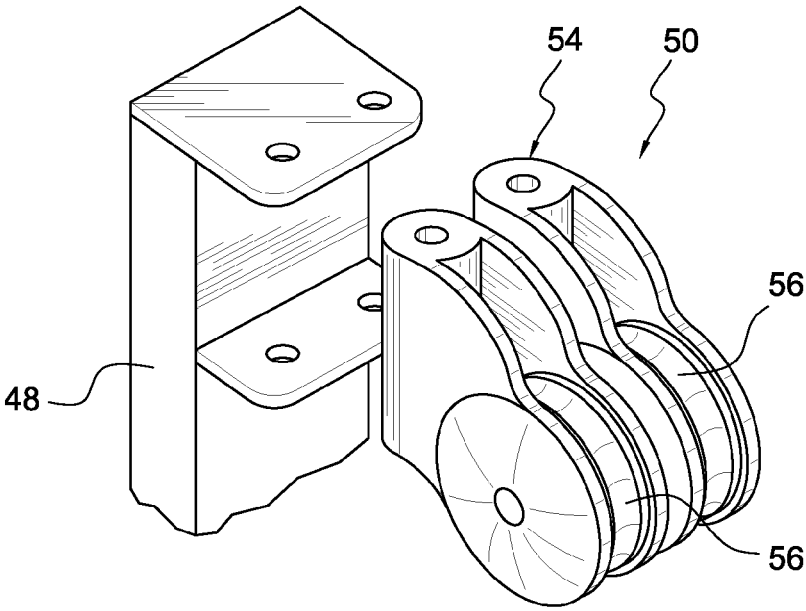
FIG. 4 is an enlarged perspective view of the pulley housing of the seated row exercise system of the present invention.

Referring now to FIG. 4, the pulley housing assembly 50 includes a pulley housing 54 attached to the vertical support member 48; and, a pair of pulleys 56 attached to the pulley housing 54 to swivel in an orthogonal direction from a plane of the vertical support member.

The cable assembly 52 is similar to the type disclosed and claimed in applicant's co-pending patent application, U.S. Ser. No. 11/062,063 (US Publcn. No. 2005/0187082), entitled "Exercise System Using Exercise Resistance Cables," which is incorporated herein in its entirety. Each exercise resistance cable apparatus includes an elastic exercise resistance cable 58. A first end of the elastic exercise resistance cable 68 is securely fixed to a cable anchor assembly that includes a cable anchor 60 attached on a side plate (i.e. gusset) 62 of the support assembly 18. A handgrip, i.e. handle 64, is connected to a second end of the elastic exercise resistance cable 58. During use the elastic exercise resistance cable is directed through an activity bay of the pulley assembly and ultimately attached, via a cable anchor ring of the cable 58, to the cable anchor 60. The cable anchor 60 can be located on the outside of the vertical support member 48, as shown in the FIG. 1 or may be located on the inside of that member 48.

The exercise cycle assembly 16 preferably includes a foot plate 66 securely positioned between the support legs and the connecting member 40 for securely supporting the exercise cycle assembly 16. The user places his feet on the foot plate to keep the exercise system 10 steadily on the ground when exercising.

The vertical support member 48 preferably includes an intermediate anchor hook 68 for providing intermediate attachment of the cable assembly 52.

Referring back now to FIG. 1, the chair 12 includes various components for exercise/rehabilitation. These components and features are disclosed and described in applicant's co-pending U.S. Ser. No. 11/612,644 (U.S. Publcn. No. 2007/0099780), entitled "Shoulder Stretcher Assembly," incorporated herein in its entirety; and, U.S. Ser. No. 11/062,063 (US Publcn. No. 2005/0187082), entitled "Exercise System Using Exercise Resistance Cables," discussed above.

Various exercise routines can be performed with the seated row exercise system of the present invention and various muscles will be effected, as shown below:

A. Seated Row:
i) Latisimus dorsi
iii) Triceps
iii) Deltoids
B. Rear Deltoids:
i) Deltoids
ii) Triceps
iii) Trapezious
iv) Rhomboids
C. Internal Rotation:
i) Deltoids
i) Triceps
D. External Rotation:
i) Deltoids
ii) Triceps Thus, the activity bays are strategically placed on the resistance chairs to allow comfortable, ergonomically friendly and safe exercise routines.

Obviously, many modifications and variations of the present invention are possible in light of the above teachings. It is, therefore, to be understood that within the scope of the appended claims, the invention may be practiced otherwise than as specifically described. For example, although this invention has been described relative to its use with an exercise chair other applications are possible such as utilizing these inventive concepts with a flat support structure that would be placed underneath a person who is bed ridden or does not have use of their legs. This embodiment would slide under the user and allow them, from a laying down position, to use the system as if they were sitting in the chair.

The invention claimed is:

1. A seated row exercise system, comprising:
a) an exercise cycle assembly that detachably connects to a chair frame of a chair, comprising:
i. a main frame having a first end portion detachably connectable to a frame element of a chair frame, said main frame including a plurality of support legs for supporting the exercise cycle assembly relative to the floor; and,
ii. a pedal assembly securely connected to said main frame; and,
b) an elongated support assembly, comprising:
i. a substantially vertical support member secured to said main frame; and,
ii. a pulley housing assembly attached to said vertical support member for supporting a cable assembly,
wherein said first end portion of said main frame comprises an elongated connecting member having a generally u-shaped cross-section for engagement with the frame element of the chair, sides of said elongated connecting member having recessed portions for a snapping engagement with the frame element.

2. The seated row exercise system of claim 1 wherein said elongated support assembly includes at least one cable anchor assembly securely attached to a lower end of said vertical support assembly for attachment of the cable assembly.

3. The seated row exercise system of claim 1 wherein said pulley housing assembly, comprises:
a) a pulley housing attached to said vertical support member; and,
b) a pair of pulleys attached to said pulley housing to swivel in an orthogonal direction from a plane of said vertical support member.

4. The seated row exercise system of claim 1 further comprising a cable assembly, comprising:
a) a pair of cables, each cable including a cable attaching element at a respective second end of each of said cables; and,
b) a pair of handles, each handle secured at a respective first end of one of said cables.

5. The seated row exercise system of claim 1 wherein said first end portion of said main frame comprises an elongated connecting member for engagement with the frame element of the chair.

6. The seated row exercise system of claim 1,
wherein said main frame includes an elongated main support element for supporting said pedal assembly; and,
wherein said first end portion of said main frame, comprises:
a stem in adjustable engagement with said main support element for changing the position of the chair frame relative to said pedal assembly; and;
an elongated connecting member securely connected to said stem, said elongated connecting member for engagement with the frame element of the chair frame.

7. The seated row exercise system of claim 6 wherein said stem is in adjustable telescopic engagement with said main support element.

8. The seated row exercise system of claim 1 wherein said plurality of support legs are positioned at a second end portion of said elongated main support element.

9. The seated row exercise system of claim 1 wherein said plurality of support legs comprises two support legs.

10. The seated row exercise system of claim 1 wherein said elongated connecting member includes an inner padding positioned on an inner surface thereof for enhancing the engagement of said elongated connecting member and said frame element.

11. The seated row exercise system of claim 1 wherein said main frame comprises a support plate securely positioned between said support legs and said connecting member for securely supporting the exercise cycle assembly.

12. A seated row exercise system, comprising:

a) an exercise cycle assembly that detachably connects to a chair frame of a chair, comprising:

i. a main frame having a first end portion detachably connectable to a frame element of a chair frame, said main frame including a plurality of support legs for supporting the exercise cycle assembly relative to the floor; and, ii. a pedal assembly securely connected to said main frame; and, b) an elongated support assembly, comprising:

i. a substantially vertical support member secured to said main frame; and, ii. a pulley housing assembly attached to said vertical support member for supporting a cable assembly, wherein said first end portion of said main frame comprises an elongated connecting member haying a generally u-shaped cross-section for engagement with the frame element of said chair, said connecting member being oriented so as to be open on its lower portion to engage a horizontal portion of the frame element of the chair.

13. The seated row exercise system of claim 12 wherein said elongated support assembly includes at least one cable anchor assembly securely attached to a lower end of said vertical support assembly for attachment of the cable assembly.

14. The seated row exercise system of claim 12 wherein said pulley housing assembly, comprises:

a) a pulley housing attached to said vertical support member; and, b) a pair of pulleys attached to said pulley housing to swivel in an orthogonal direction from a plane of said vertical support member.

15. The seated row exercise system of claim 12 further comprising a cable assembly, comprising:

c) a pair of cables, each cable including a cable attaching element at a respective second end of each of said cables; and, d) a pair of handles, each handle secured at a respective first end of one of said cables.

* * * * *